US006805182B2

(12) United States Patent
Ballarotti

(10) Patent No.: US 6,805,182 B2
(45) Date of Patent: Oct. 19, 2004

(54) BOTTLE LABELING MACHINE

(75) Inventor: Mario Ballarotti, Marmirolo (IT)

(73) Assignee: P.E. S.r.l., Porto Mantovano (IT)

( * ) Notice: Subject to any disclaimer, the term of this patent is extended or adjusted under 35 U.S.C. 154(b) by 0 days.

(21) Appl. No.: 10/158,938

(22) Filed: Jun. 3, 2002

(65) Prior Publication Data

US 2002/0185233 A1 Dec. 12, 2002

(30) Foreign Application Priority Data

Jun. 6, 2001 (IT) ..... MN2001A0027

(51) Int. Cl.[7] ..... B65C 9/04; B65C 9/06

(52) U.S. Cl. ..... 156/556; 156/566; 156/567; 156/DIG. 27; 198/377.01; 198/406

(58) Field of Search ..... 156/556, 557, 156/566, 567, DIG. 24–27; 198/373, 377.01, 377.02, 406, 377.03, 377.07, 379, 378, 394

(56) References Cited

U.S. PATENT DOCUMENTS 4,512,456 A * 4/1985 Peyton ..... 198/470.1
4,613,397 A * 9/1986 Buchholz ..... 156/476
4,624,098 A * 11/1986 Trendel ..... 53/314
5,121,827 A * 6/1992 Ribordy ..... 198/377.06
5,137,136 A * 8/1992 Humele ..... 198/379
5,185,053 A 2/1993 Tomashauser et al.
5,259,913 A * 11/1993 Stover ..... 156/566
6,308,816 B1 * 10/2001 Bankuty et al. ..... 198/395
6,398,006 B1 * 6/2002 Dault ..... 198/377.01
6,551,439 B1 * 4/2003 Hill et al. ..... 156/273.3

FOREIGN PATENT DOCUMENTS

| | | |
|---|---|---|
| DE | 38 34 874 | 4/1990 |
| FR | 794 167 | 2/1936 |
| WO | 98 55389 | 12/1998 |

* cited by examiner

*Primary Examiner*—Sue A. Purvis
(74) *Attorney, Agent, or Firm*—Guido Modiano; Albert Josif; Daniel O'Byrne

(57) ABSTRACT

A bottle labeling machine, comprising a rotating carousel provided with a supporting structure for pans on which the bottles rest and comprising input and output star conveyors, the input and output star conveyors being arranged at a fixed elevation, the rotating carousel being provided with means suitable to change the elevation of the pan supporting structure.

8 Claims, 5 Drawing Sheets

26
25
5b
5
5a
5a
24
4
24a
6a
6b
6
6a
6
35
23
29
21
30
21a
28
32
31
27
33
34
39
38
37
36
22
1

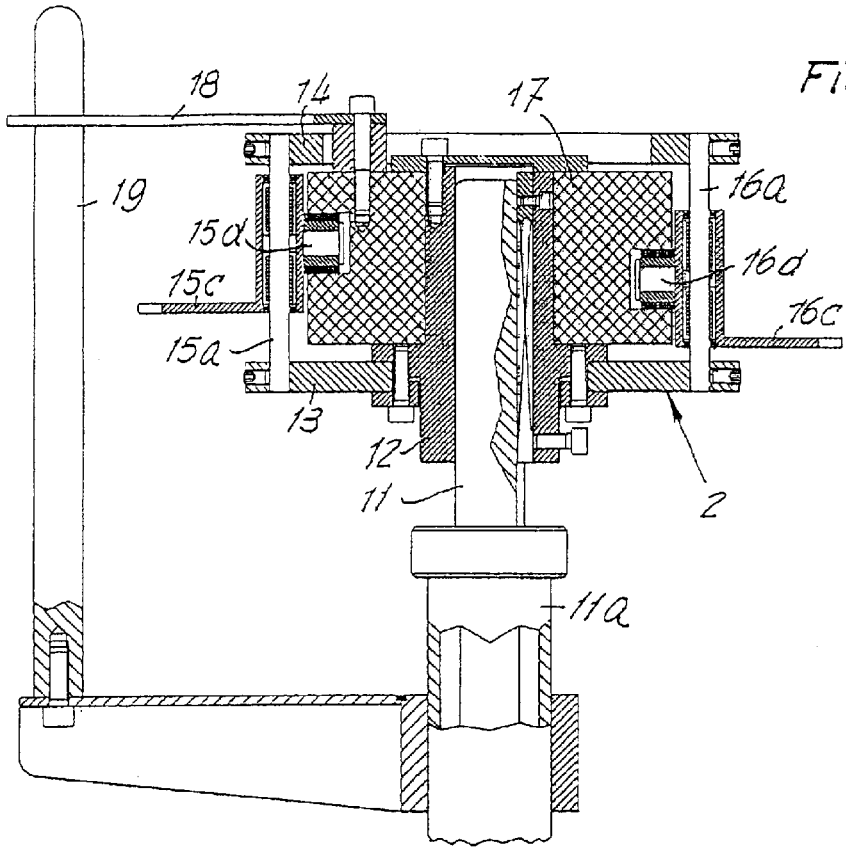
Fig. 5
Fig. 4
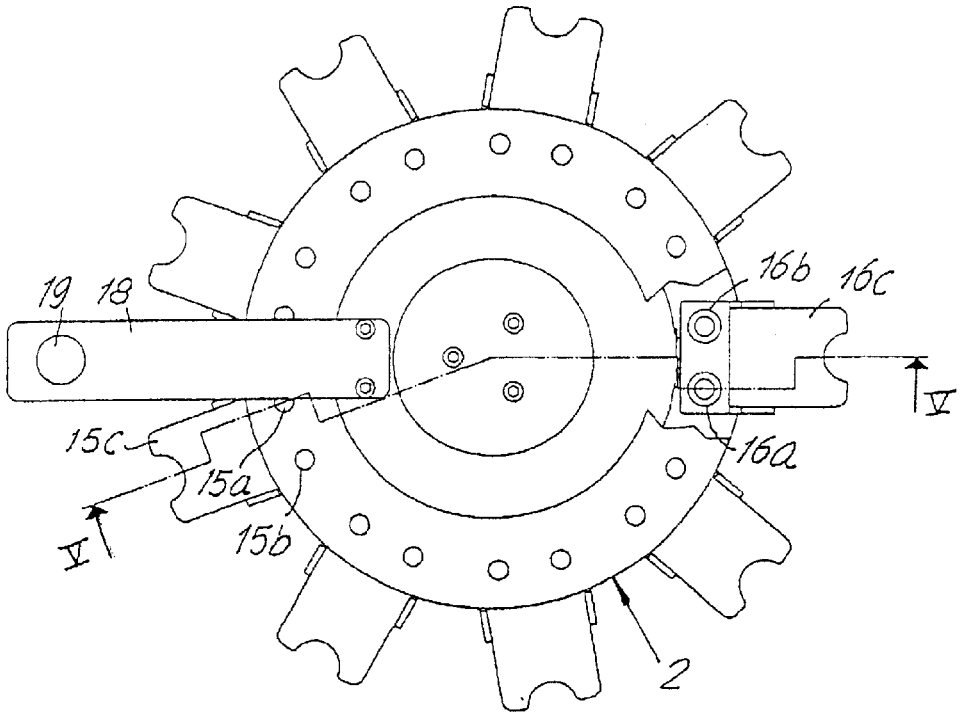

BOTTLE LABELING MACHINE

BACKGROUND OF THE INVENTION

The present invention relates to a bottle labeling machine.

It is known that there are bottle labeling machines that comprise a rotating carousel and input and output star conveyors, which are respectively suitable to pick up the incoming bottles to place them in the carousel and to receive the labeled bottles in order to transfer them to a removal line.

Such machines are inserted in a filling line that comprises, directly upstream, a closure fitting unit which has, in a very common embodiment, an output star conveyor provided with brackets that support the bottles, one per bracket, at the neck, and are arranged at a fixed elevation, no adjustment being required when it is necessary to perform format changes, i.e., when passing from the processing of bottles having certain dimensions to bottles having different dimensions.

SUMMARY OF THE INVENTION

The aim of the present invention is to provide a labeling machine that is capable of receiving directly the bottles from the output star conveyor of the closure fitting unit and allows very easy format changes.

This aim is achieved by a bottle labeling machine according to the invention, which comprises a rotating carousel provided with a supporting structure for pans on which the bottles rest and an overlying structure for supporting heads for centering said bottles, further comprising input and output star conveyors, which are respectively suitable to pick up the incoming bottles in order to place them on said carousel and to receive the labeled bottles in order to transfer them to a removal line, characterized in that said input and output star conveyors are arranged at a fixed elevation, and in that said rotating carousel is provided with means suitable to change the elevation of the pan supporting structure.

BRIEF DESCRIPTION OF THE DRAWINGS

Further characteristics and advantages of the present invention will become better apparent from the following detailed description of a preferred but not exclusive embodiment thereof, illustrated by way of non-limitative example in the accompanying drawings, wherein:

FIG. 4 is a detail plan view of the input star conveyor;

FIG. 5 is a partial sectional view, taken along the line V—V of FIG. 4;

DESCRIPTION OF THE PREFERRED EMBODIMENTS

Figure 1:
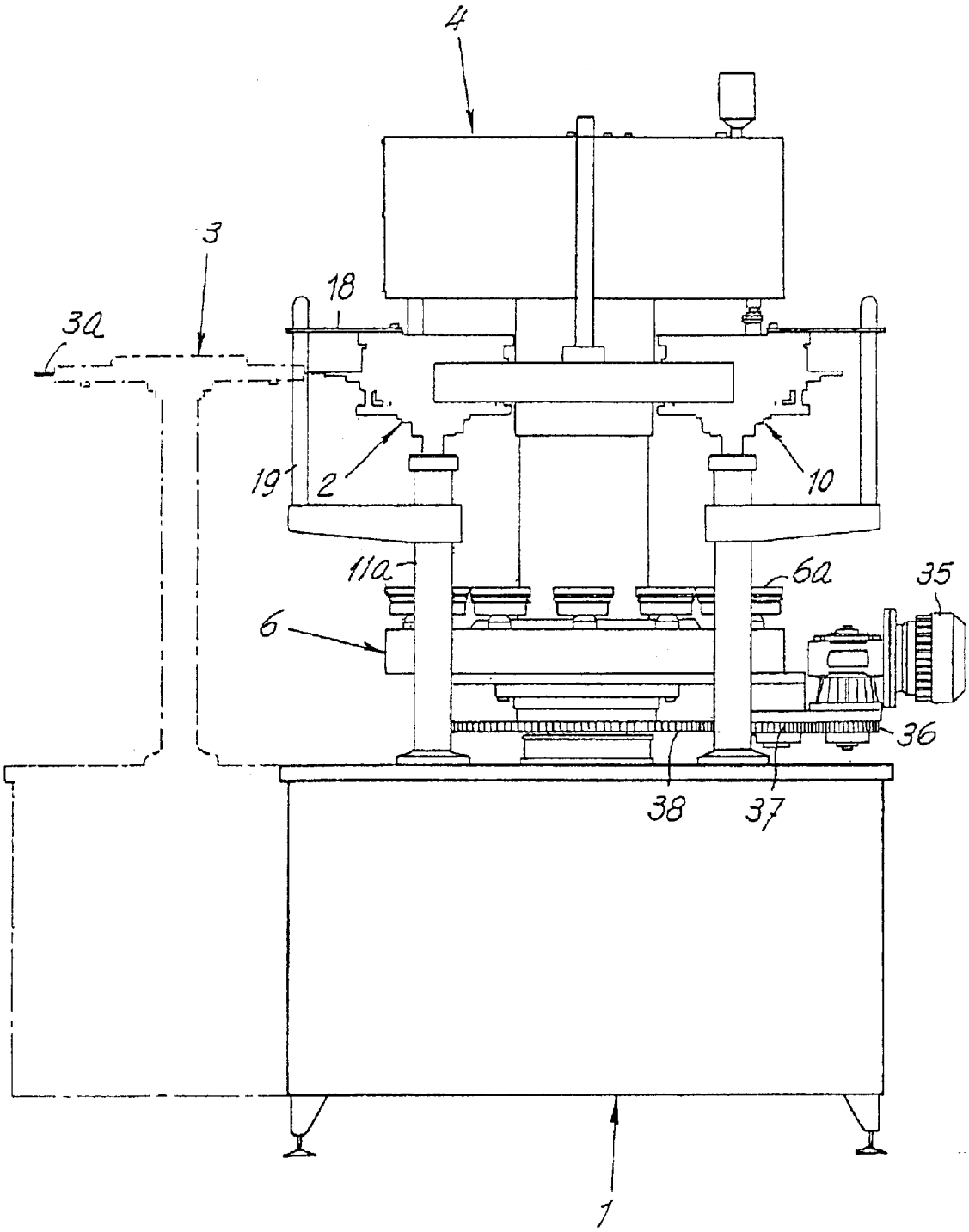
FIG. 1 is a front view of the machine according to the present invention.
Figure 2:
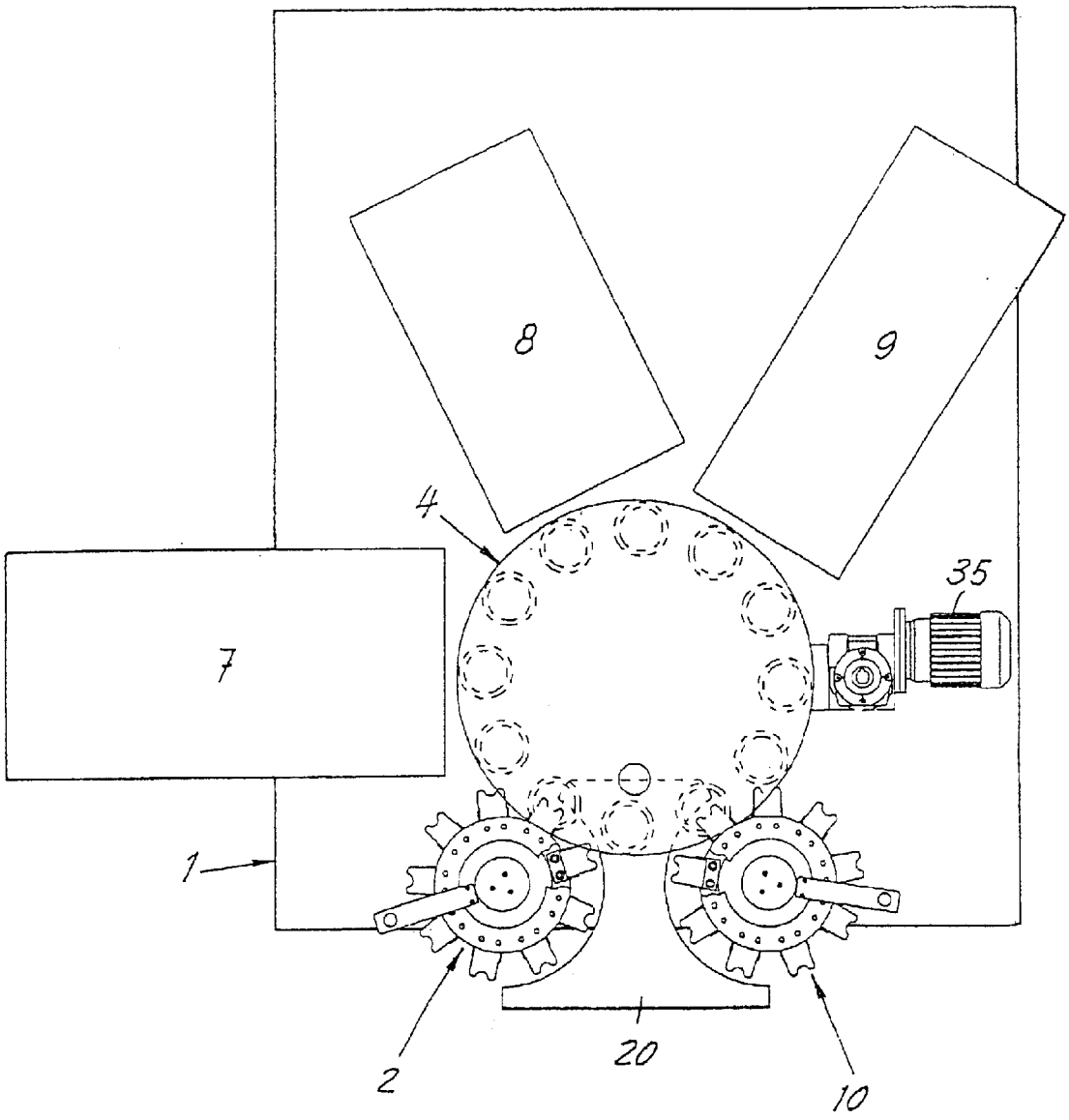
FIG. 2 is a schematic plan view of the machine.

With reference to the figures, the reference numeral 1 designates a footing of the machine that supports an input star conveyor 2, which is suitable to pick up directly the bottles from an output star conveyor 3 of the closure fitting machine that is arranged upstream of the labeling machine on the filling line and is shown in dot-and-dash lines in FIG. 1 by way of reference; the output star conveyor 3 of the closure fitting unit is provided with brackets, such as 3*a*, for supporting the individual bottles at their neck; said brackets are arranged at a fixed elevation, i.e., at an elevation that does not change when the format is changed.

Figure 3:
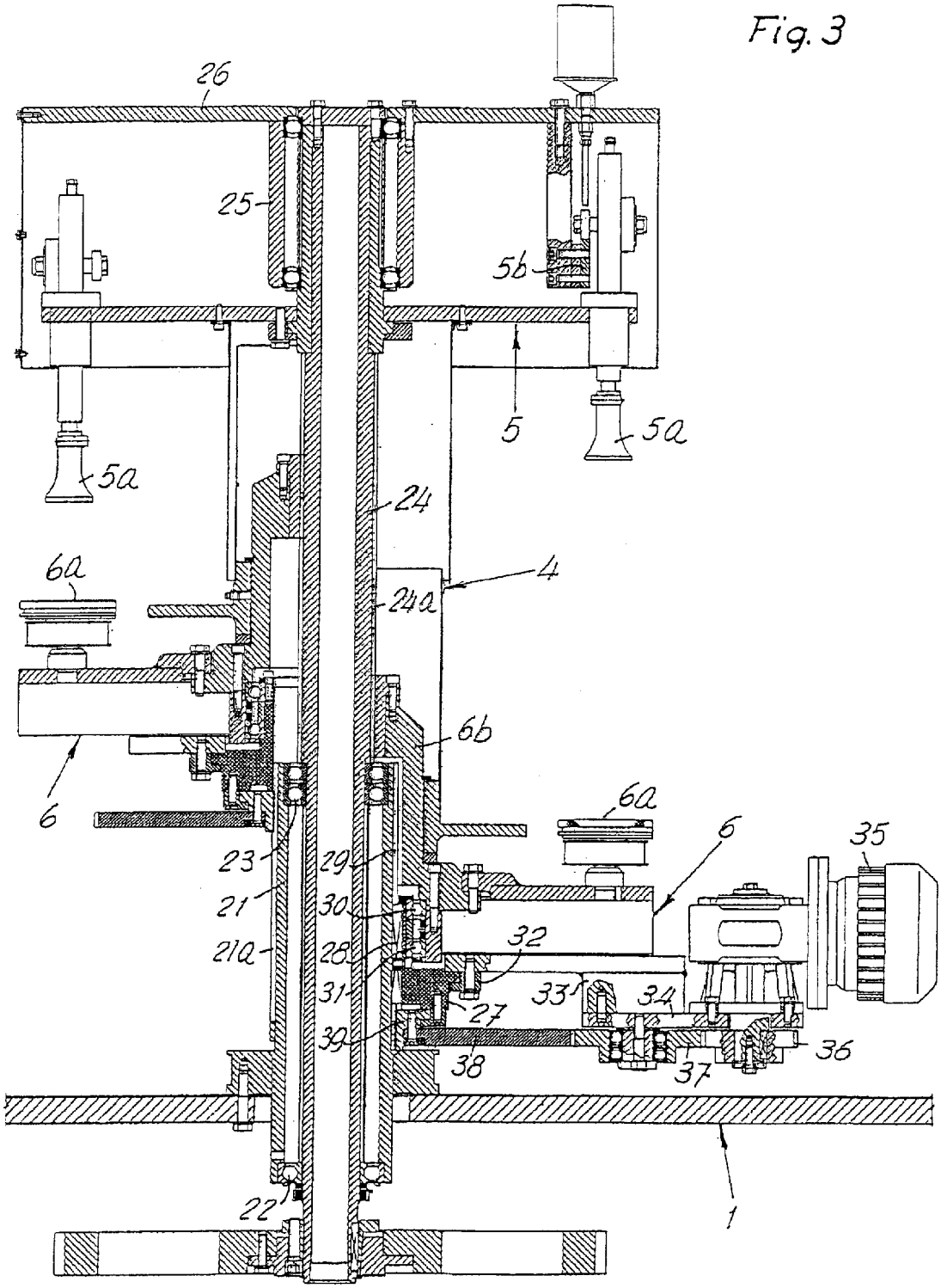
FIG. 3 is a sectional view of the carousel, with the pan supporting structure shown at two different elevations, respectively to the right and to the left of the rotation axis.
Figure 6:
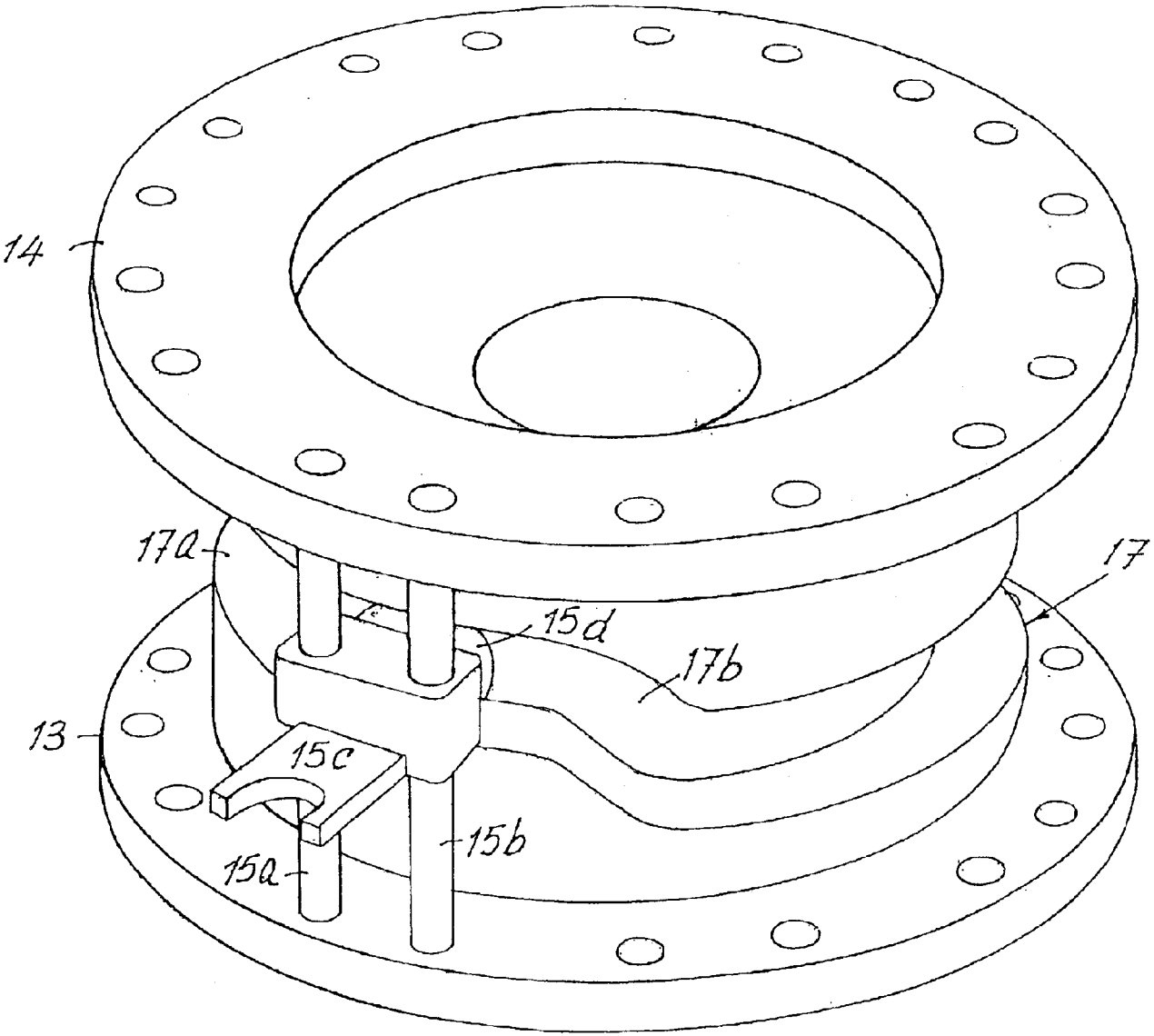
FIG. 6 is a perspective view of the cam provided at the input star conveyor.

The footing 1 also supports a rotating carousel, generally designated by the reference numeral 4, which comprises a structure 5 for supporting heads 5*a* for centering the bottles, and a structure 6 for supporting pans 6*a* on which the bottles rest, shown in its overall configuration in FIG. 1 and illustrated in FIG. 3 in a double view: at the maximum elevation in the left part of the drawing and at the minimum elevation in the right part.

The machine is completed by the following components, also supported by the footing 1: a front adhesive application unit 7, a label magazine unit 8, and a rear adhesive application unit 9, which are known per se and are shown merely by way of reference, and finally an output star conveyor 10, which has the same shape as the input star conveyor 2.

The input star conveyor 2 comprises a rotating shaft 11 which is supported by a post 11*a* that protrudes from the footing 1 and with which a bush 12 is associated; the bush supports an assembly formed by disks 13 and 14, which are connected by pairs of guides such as 15*a*, 15*b* and 16*a*, 16*b* along which there slide brackets for supporting the bottles at their neck, such as 15*c* and 16*c*, which are conveniently moved vertically during the rotation of the assembly of a cam 17, which is anchored to a protrusion 18 that protrudes from a post 19.

The cam, in addition to being locked rotationally, is therefore at a fixed elevation, no adjustment thereof being required when changing the format of the bottles being processed, exactly as occurs for the output star conveyor 3 of the closure fitting unit mentioned earlier.

The cam 17 has a track that is suitable to accommodate wheels that are rigidly coupled to the individual brackets, such as 15*d* and 16*d* for the brackets 15*c* and 16*c*, and the track comprises an ascending portion 17*a* and a steeply descending portion 17*b*.

Operating conditions therefore occur in which a bottle, picked up by a bracket such as 15*c* at the neck directly from a bracket of the output star conveyor 3 of the closure fitting unit and kept in position by an abutment barrier 20, performs, during the rotation of the star conveyor 2, first a slight upward motion, which makes it lie above the pan 6*a* meant to accommodate it, and a subsequent rapid lowering, so as to allow the insertion of said bottle in said pan; simultaneously with said downward movement of the bottle that rests on a pan, the cam 5*b* causes the descent of the overlying centering head 5*a*, with consequent permanent locking of the bottle.

Movements in the opposite direction of the bottle, which is now labeled, occur at the output star conveyor 10, which as mentioned has the same configuration as the input star conveyor 2.

When performing format change operations, it is of course necessary to ensure the condition in which the bottles are locked as described, i.e., in which they rest on a pan 6*a* at the bottom and are in contact, at the top, with a centering head 5*a*; therefore, while keeping constant the elevation of the supporting structure 5 of said heads, the elevation of the supporting structure 6 of the pans 6*a* is changed in order to adapt the machine to the size of the bottles to be processed.

The invention therefore comprises a fixed column 21, which protrudes vertically from the footing 1 and is meant to support inside it, by means of bearings 22 and 23, a rotating shaft 24, which is provided at the top with the structure 5 for supporting the centering heads 5*a*, which as mentioned are actuated by the cam 5*b*, which is fixed and protrudes, like a cylinder 25, from a fixed cover 26; the fixed column 21 has a helical thread 21*a* at the is outer surface.

Further, the reference numeral 27 designates a slider that is suitable to perform only axial sliding movements along the column 21 by way of the presence of a lug 28 that is rigidly coupled thereto and is inserted in a slot 29 on the column: the slider 27 supports, at bearings 30 and 31, the structure 6 for supporting the pans 6*a*, which is provided with the tab 6*b*, which is rotationally rigidly coupled to the rotating shaft 24 and can slide axially along said shaft by means of the slot 24*a*.

The slider 27 supports a ledge 33, which is locked by a ring 32 and to which a plate 34 for supporting a gearmotor 35 is fixed; the gearmotor is meant to turn a gear 36, which is connected, with a gear 37 interposed, to a gear 38, rigidly coupled to a female screw 39, which is associated with the helical thread 21*a* provided on the fixed column 21 and is in contact with the slider 27.

The female screw 39, in its helical motion determined by the gearmotor 35, guides with vertical motions the slider 27 that rests thereon and entrains the structure 6 for supporting the pans 6*a* so as to bring said structure to the intended elevation.

The described invention is susceptible of numerous modifications and variations, all of which are within the scope of the same inventive concept; thus, for example, the means suitable to change the elevation of the pan supporting structure may be provided in any manner.

The disclosures in Italian Patent Application No. MN2001A000027 from which this application claims priority are incorporated herein by reference.

What is claimed is:

1. A bottle labeling machine, comprising a rotating carousel provided with a supporting structure which supports a plurality of pans on which the bottles rest and an overlying structure for supporting heads for centering said bottles, further comprising input and output star conveyers, which are respectively suitable to pick up the incoming bottles in order to place them on said carousel and to receive the labeled bottles from said carousel in order to transfer them to a removal line, said input and output star conveyers being arranged at a fixed elevation for respectively picking up incoming bottles and transferring bottles to the removal line at said fixed elevation of the input and output star conveyors, said overlying structure being also arranged at a fixed elevation for having the bottles placed thereon from said input conveyor at the fixed elevation of said overlying structure and for having the bottles be received by said output conveyor at the fixed elevation of said overlying structure, and said rotating carousel being provided with means suitable to change the elevation of the pan supporting structure for changing simultaneously the elevation of all of the plurality of pans supported by said pan supporting structure for adapting the machine to different size bottles without changing the fixed elevations of all of said input and output star conveyors and of said overlying structure for supporting heads for centering said bottles of said carousel.

2. The machine according to claim 1, wherein the input star conveyor is provided with brackets that are suitable to support the bottles at the neck after picking them up directly from an output star conveyor of the closure fitting unit arranged upstream of the labeling unit on the filling line, the output star conveyor of said labeling unit being provided with similar brackets.

3. The machine according to claim 1, wherein the input star conveyor is provided with a cam that is fixed rotationally and at a fixed elevation and is suitable to induce a bottle supporting bracket during its rotary motion so as to perform elevation changes that comprise an upward motion immediately after engaging a bottle, so as to make said bottle lie above the pan meant to accommodate it, and a subsequent rapid downward motion, so as to insert the bottle in said pan, which occurs simultaneously with the descent of the centering head that lies above said pan in order to lock the bottle, which is determined by appropriately provided means, the output star conveyor being provided with a similar fixed cam that is suitable to produce motions in the opposite direction an the bracket.

4. The machine according to claim 1, wherein the rotating carousel comprises:

a fixed column, which rises vertically from the footing of the machine and is meant to support internally a rotating shaft provided, at its top, at a fixed elevation, with the centering head supporting structure, and, at its outer surface, with a helical thread;

a slider, which is arranged at the peripheral region of said column and is suitable to perform only axial sliding movements along said column and to rotatably support the pan supporting structure, which is provided with a tab that is rotationally rigidly coupled to said rotating shaft and can slide axially along said shaft;

a motor, which is supported by said slider and is suitable to turn a female screw that is associated with the helical thread provided on the outer surface of said fixed column below the slider and in contact therewith.

5. A bottle labeling machine in combination with a closure fitting unit, the bottle labeling machine comprising:

a rotating carousel provided with a supporting structure which supports a plurality of pans on which the bottles rest and an overlying structure for supporting heads for centering said bottles;

input and output star conveyors, which are respectively suitable to pick up the incoming bottles in order to place them on said carousel and to receive the labeled bottles from said carousel in order to transfer them to a removal line, said input and output star conveyors being arranged at a fixed elevation for respectively picking up incoming bottles and transferring bottles to the removal line at said fixed elevation of the input and output star conveyors, said overlying structure being also arranged at a fixed elevation for having the bottles placed thereon from said input conveyor at the fixed elevation of said overlying structure and for having the bottles be received by said output conveyor at the fixed elevation of said overlying structure, and said rotating carousel being provided with means suitable to change the elevation of the pan supporting structure for changing simultaneously the elevation of all of the plurality of pans supported by said pan supporting structure for adapting the machine to different size bottles without changing the fixed elevations of all of said input and output star conveyors and of said overlying structure for supporting heads for centering said bottles of said carousel.

6. The combination of claim 5, wherein the input star conveyor of said bottle labeling machine is provided with brackets that are suitable to support the bottles at the neck after picking them up directly from an output star conveyor of the closure fitting unit arranged upstream of the labeling unit on the filling line, the output star conveyor of said labeling unit being provided with similar brackets.

7. The combination of claim 5, wherein the input star conveyor of said bottle labeling machine is provided with a cam that is fixed rotationally and at a fixed elevation and is suitable to induce a bottle supporting bracket during its rotary motion so as to perform elevation changes that comprise an upward motion immediately after engaging a bottle, so as to make said bottle lie above the pan meant to accommodate it, and a subsequent rapid downward motion, so as to insert the bottle in said pan, which occurs simultaneously with the descent of the centering head that lies above said pan in order to lock the bottle, which is determined by appropriately provided means, the output star conveyor of said bottle labeling machine being provided with a similar fixed cam that is suitable to produce motions in the opposite direction on the bracket.

8. The combination of claim 5, wherein the rotating carousel comprises:

a fixed column, which rises vertically from the footing of the machine and is meant to support internally a rotating shaft provided, at its top, at a fixed elevation, with the centering head supporting structure, and, at its outer surface, with a helical thread;

a slider, which is arranged at the peripheral region of said column and is suitable to perform only axial sliding movements along said column and to rotatably support the pan supporting structure, which is provided with a tab that is rotationally rigidly coupled to said rotating shaft and can slide axially along said shaft;

a motor, which is supported by said slider and is suitable to turn a female screw that is associated with the helical thread provided on the outer surface of said fixed column below the slider and in contact therewith.

* * * * *